US009482229B2

(12) United States Patent
Adaniya

(10) Patent No.: US 9,482,229 B2
(45) Date of Patent: Nov. 1, 2016

(54) MOTOR-DRIVEN COMPRESSOR

(75) Inventor: Taku Adaniya, Aichi-ken (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 359 days.

(21) Appl. No.: 13/596,547

(22) Filed: Aug. 28, 2012

(65) Prior Publication Data

US 2013/0071266 A1 Mar. 21, 2013

(30) Foreign Application Priority Data

Sep. 21, 2011 (JP) ..... 2011-205448

(51) Int. Cl.

| | |
|---|---|
| ***F04C 28/28*** | (2006.01) |
| ***F04C 23/00*** | (2006.01) |
| ***F04C 28/06*** | (2006.01) |
| ***F04C 29/12*** | (2006.01) |
| ***F25B 31/02*** | (2006.01) |
| ***F25B 41/04*** | (2006.01) |
| *F04C 18/02* | (2006.01) |

(52) U.S. Cl.

CPC ..... *F04C 28/28* (2013.01); *F04C 23/008* (2013.01); *F04C 28/06* (2013.01); *F04C 29/126* (2013.01); *F25B 31/026* (2013.01); *F25B 41/043* (2013.01); *F04C 18/0215* (2013.01); *F04C 2270/701* (2013.01); *F25B 2500/26* (2013.01); *F25B 2500/27* (2013.01)

(58) Field of Classification Search

CPC ..... F04B 49/02; F04C 18/02; F04C 18/04; F04C 28/26; F04C 28/28; F04C 29/123; F04C 29/126

USPC ..... 417/366, 369, 370, 410.5; 418/55.1

See application file for complete search history.

(56) References Cited

U.S. PATENT DOCUMENTS

| | | | | |
|---|---|---|---|---|
| 4,560,330 | A | | 12/1985 | Murayama et al. |
| 4,741,674 | A | | 5/1988 | Tischer |
| 4,840,545 | A | * | 6/1989 | Moilanen ..... 417/301 |
| 5,141,420 | A | | 8/1992 | Nambiar |

(Continued)

FOREIGN PATENT DOCUMENTS

| | | | |
|---|---|---|---|
| CN | 101205909 | A | 6/2008 |
| CN | 101415947 | A | 4/2009 |

(Continued)

OTHER PUBLICATIONS

Communication dated Oct. 2, 2014, issued by the European Patent Office in corresponding European Application No. 12185241.2.

(Continued)

*Primary Examiner* — Alexander Comley
*Assistant Examiner* — Kenneth J Hansen
(74) *Attorney, Agent, or Firm* — Sughrue Mion, PLLC

(57) ABSTRACT

A motor-driven compressor includes an electric motor, a compression mechanism driven by the electric motor so as to compress refrigerant gas, a metal housing accommodating the electric motor and the compression mechanism, a suction passage communicable with interior of the housing wherein refrigerant gas flows through the suction passage, a discharge passage communicable with the interior of the housing wherein refrigerant gas discharged from the compression mechanism flows through the discharge passage and a check valve that is provided in at least one of the suction passage and the discharge passage, opened while the compressor is in operation and closed while the compressor is at a stop.

5 Claims, 4 Drawing Sheets

(56) References Cited

U.S. PATENT DOCUMENTS

| | | | | |
|---|---|---|---|---|
| 5,395,214 | A | 3/1995 | Kawahara et al. | |
| 5,496,160 | A * | 3/1996 | Richardson et al. | 418/55.1 |
| 2004/0258539 | A1* | 12/2004 | Iwanami et al. | 417/319 |
| 2005/0238518 | A1 | 10/2005 | Ginies et al. | |
| 2006/0065012 | A1 | 3/2006 | Kudo | |
| 2009/0269222 | A1* | 10/2009 | Fukasaku et al. | 417/410.1 |

FOREIGN PATENT DOCUMENTS

| | | | |
|---|---|---|---|
| CN | 101566144 | A | 10/2009 |
| CN | 102062091 | A | 5/2011 |
| GB | 2350157 | A | 11/2000 |
| JP | 63138176 | A | 6/1988 |
| JP | 04231691 | A | 8/1992 |
| JP | 06010838 | A | 1/1994 |
| JP | 2004251130 | A | 9/2004 |
| JP | 2005139935 | A | 6/2005 |
| JP | 2005-337264 | A | 12/2005 |
| JP | 2009-264279 | A | 11/2009 |
| JP | 2009281345 | A1 | 12/2009 |
| JP | 2010031677 | A | 2/2010 |
| WO | 2007114582 | A1 | 10/2007 |

OTHER PUBLICATIONS

Communication dated Sep. 29, 2014, issued by the State Intellectual Property Office of the People's Republic of China in counterpart Application No. 201210348025.1.

Communication dated Sep. 30, 2014, issued by the Japanese Patent Office in counterpart Application No. 2011205448.

Communication dated Dec. 1, 2015 from the State Intellectual Property Office of the P.R.C. in counterpart application No. 201210348025.1.

Communication dated Jun. 3, 2015 from the State Intellectual Property Office of the People's Republic of China in counterpart application No. 201210348025.1.

* cited by examiner

MOTOR-DRIVEN COMPRESSOR

BACKGROUND OF THE INVENTION

The present invention relates to a motor-driven compressor that has in the housing thereof an electric motor and a compression mechanism compressing refrigerant gas by the rotation of the electric motor.

Generally, a motor-driven compressor accommodates in a metal housing thereof an electric motor and a compression mechanism compressing refrigerant gas by the rotation of the electric motor. This kind of motor-driven compressor is connected to an external refrigerant circuit and refrigerant gas flows in the housing and through the compression mechanism during the operation of the motor-driven compressor. When the motor-driven compressor is at a stop, refrigerant gas is cooled and liquefied and the liquefied refrigerant (hereinafter referred to as "liquid refrigerant") tends to be accumulated in the housing of the motor-driven compressor. Liquid refrigerant contains lubricating oil. It is noted that a specific kind of lubricating oil mixed with liquid refrigerant reduces the electrical resistivity of liquid refrigerant. A conductive part such as a terminal of wiring may be located in the electric motor or in the vicinity thereof in the housing and is exposed to liquid refrigerant. When such conductive part is immersed in liquid refrigerant accumulated in the housing, the insulation between the conductive part and the housing may be deteriorated.

Japanese Patent Application Publication 2009-264279 discloses a motor-driven compressor that improves the insulation between a conductive part and a housing of the motor-driven compressor. The motor-driven compressor has an electric motor that has a stator including a coil. The coil is formed of three-phase conductive wires. The ends of the three-phase conductive wires are drawn out from the coil and bundled together to form a bundled part. A wiring connection part is formed at the end of the bundled part by connecting the ends of the conductive wires and the wiring connection part serves as a neutral point. The bundled part is inserted through an insulation tube and an extra length part is formed in the bundled part by elongating the shortest insulation distance between the wiring connection part and the housing. The insulating resistance between the wiring connection part and the housing is improved by extending the shortest insulation distance between the wiring connection part and the housing. Therefore, the deterioration of the insulation between the conductive part and the housing due to the immersion in liquid refrigerant may be prevented.

However, the motor-driven compressor disclosed in the Publication needs extra space in the housing for disposing the extra length part. The provision of the extra length part increases the size of the motor-driven compressor and, therefore, the degree of freedom of mounting the motor-driven compressor on a vehicle is deteriorated. Depending on the space limitation in mounting of the motor-driven compressor, the provision of the extra length part may make it extremely difficult to mount the compressor.

Liquid refrigerant accumulated in the housing during the stop of the motor-driven compressor is due to the refrigerant gas cooled and liquefied in the external refrigerant circuit, as well as the refrigerant gas cooled and liquefied in the housing.

The liquid refrigerant produced in the external refrigerant circuit and flowed into the housing adds to the accumulation of the liquid refrigerant in the housing.

In a case of a motor-driven compressor where the extra length part can not be provided due to space limitation, a conductive part tends to be immersed in liquid refrigerant, so that the insulation between the conductive part and a housing deteriorates.

Additionally, when liquid refrigerant is accumulated in the housing at a start-up of the motor-driven compressor, the liquid refrigerant is vaporized in the housing and the pressure in the housing is increased excessively.

In such a case, a larger torque is required at the start-up of the compressor, so that the load applied to the motor-driven compressor increases.

The present invention is directed to providing a motor-driven compressor that prevents liquid refrigerant from flowing into the housing of the compressor from the external refrigerant circuit to be accumulated in the motor-driven compressor so as to ensure the insulation of the conductive part of the motor-driven compressor.

SUMMARY OF THE INVENTION

A motor-driven compressor includes an electric motor, a compression mechanism driven by the electric motor so as to compress refrigerant gas, a metal housing accommodating the electric motor and the compression mechanism, a suction passage communicable with interior of the housing wherein refrigerant gas flows through the suction passage, a discharge passage communicable with the interior of the housing wherein refrigerant gas discharged from the compression mechanism flows through the discharge passage and a check valve that is provided in at least one of the suction passage and the discharge passage, opened while the compressor is in operation and closed while the compressor is at a stop.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

The following will describe a motor-driven compressor (hereinafter referred to as compressor) according to the first embodiment with reference to FIGS. 1 through 3. The compressor 10 which is designated by numeral 10 in FIG. 1 is of a scroll type and used for a hybrid vehicle equipped with an electric motor and an engine for driving the vehicle.

The compressor forms a part of refrigerant circuit of a vehicle air conditioner. The vehicle air conditioner includes a cooling unit (not shown) as a condenser, a receiver, an expansion valve, an evaporator, as well as the compressor 10, and tubes connecting the above devices.

Figure 1:
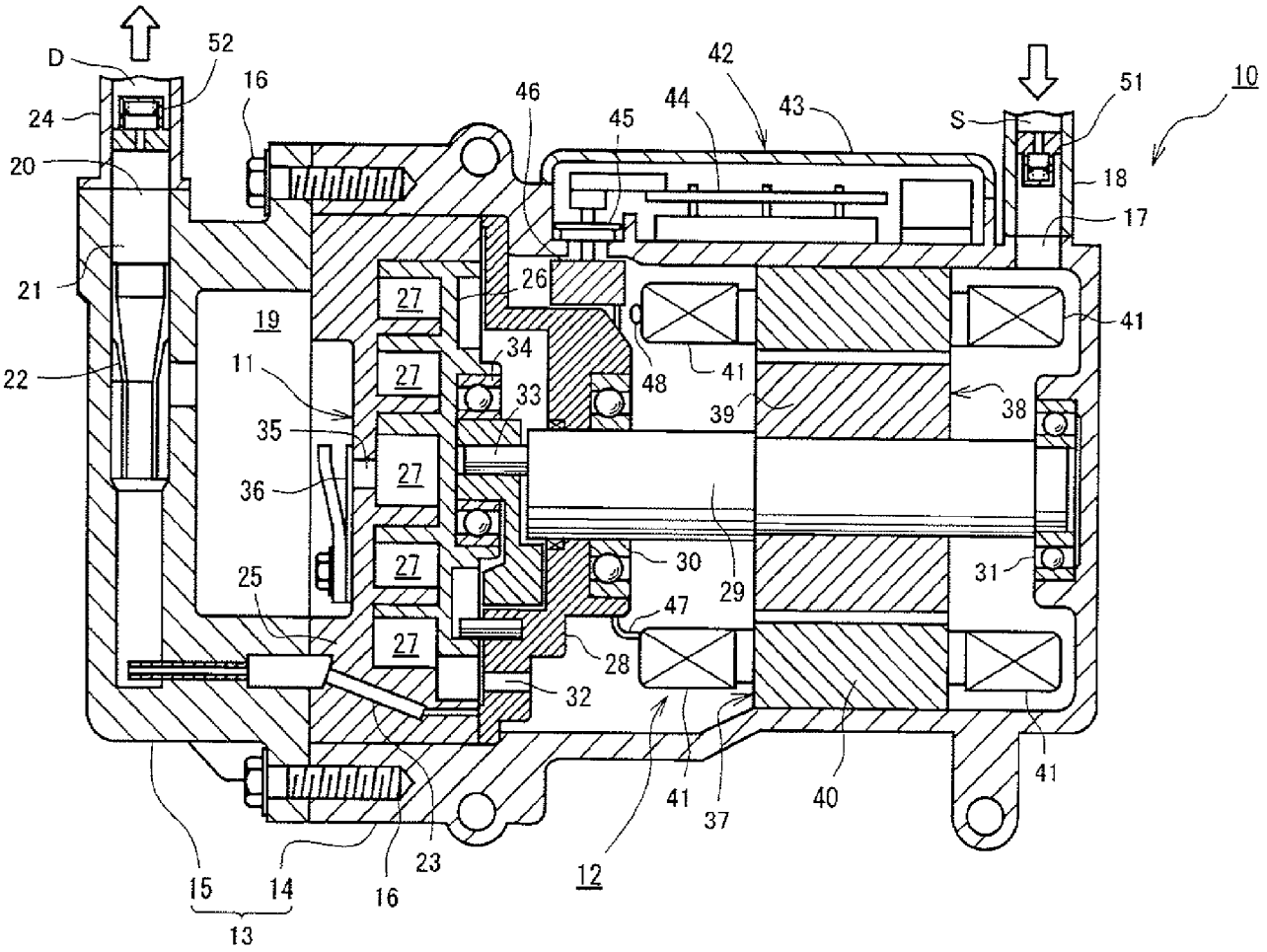
FIG. 1 is a longitudinal cross sectional view of a motor-driven compressor according to a first embodiment of the present invention.

As shown in FIG. 1, the compressor 10 includes an electric motor 12, a compression mechanism 11 that is integrated with and driven by the electric motor 12 to compress refrigerant gas and a metal housing 13 made of an aluminum alloy and including a first housing 14 and a second housing 15. The first housing 14 and the second housing 15 are joined together at the inner ends thereof by means of bolts 16 into the housing 13. The compressor 10 is disposed in a horizontal position in an engine room.

The compression mechanism 11 and the electric motor 12 are accommodated in the first housing 14 of the compressor 10. The first housing 14 has formed therethrough an inlet 17 at a position above the electric motor 12. The first housing 14 has formed therein a suction space that is placed under a suction pressure. The suction space forms a part of the interior of the housing 13. The inlet 17 is connected to a tube 18 of external refrigerant circuit. The tube 18 forms a suction passage S that is communicable through a suction check valve 51 which will be described in detail hereinafter with the suction space of the first housing 14 in which the electric motor 12 is disposed. During the operation of the compressor 10, low-pressure refrigerant gas flows through the inlet 17 into the suction space of the first housing 14. The tube 18 is located more adjacent to the electric motor 12 than a tube 24 that forms a discharge passage D which will be described later.

The second housing 15 forms therein a discharge chamber 19 that is communicable with the compression mechanism 11. The second housing 15 has formed therethrough in the upper part thereof an outlet 20 that is communicable with the external refrigerant circuit through a discharge check valve 52 which will be described in detail in later part hereof. The second housing 15 has also formed therein a communication passage 21 connecting the discharge chamber 19 and the outlet 20. An oil separator 22 is installed in the communication passage 21 for separating lubricating oil in the form of a mist from refrigerant gas discharged from the compression mechanism 11. An oil return passage 23 is formed below the oil separator 22 for allowing lubricating oil to flow from the bottom of the communication passage 21 back to the compression mechanism 11. The outlet 20 of the compressor 10 is connected to the tube 24 of the external refrigerant passage that forms the discharge passage D. The tube 24 is in communication with the discharge chamber 19 in the second housing 15 through the communication passage 21. In other words, the tube 24 is in communication with the interior of the housing 13 where the compression mechanism 11 is disposed. During the operation of the compressor 10, high-pressure refrigerant gas discharged from the compression mechanism 11 into the discharge chamber 19 flows to the outlet 20 through the communication passage 21 and out to the external refrigerant circuit through the tube 24.

The compression mechanism 11 includes a fixed scroll 25 that is fixed in the first housing 14 and a movable scroll 26 that makes an orbital movement relative to the fixed scroll 25. A compression chamber 27 is formed between the fixed scroll 25 and the movable scroll 26.

A shaft support member 28 is provided in the first housing 14 between the electric motor 12 and the fixed scroll 25. The shaft support member 28 forms a part of the compression mechanism 11 and includes a bearing 30. The electric motor 12 includes a rotary shaft 29 that is supported at the opposite ends thereof by the shaft support member 28 through the bearing 30 and the first housing 14 through a bearing 31, respectively. The shaft support member 28 has formed therethrough a suction port 32 that is opened to the aforementioned suction space in the first housing 14 and communicable with the compression chamber 27. Refrigerant gas flowed into the suction space in the first housing 14 through the inlet 17 flows into the compression chamber 27 through the suction port 32.

The rotary shaft 29 of the electric motor 12 has at one end thereof adjacent to the compression mechanism 11 an eccentric pin 33 on which the movable scroll 26 is provided through a bearing 34. The rotation of the rotary shaft 29 makes an orbital movement of the movable scroll 26, thereby causing the compression chamber 27 to move radially inward thereby to reduce its volume. Refrigerant gas flows into the compression chamber 27 through the suction port 32 with an increase of volume of the compression chamber 27 and is compressed in the compression chamber 27 with a decrease of volume of the compression chamber 27. The fixed scroll 25 has formed therethrough at the center thereof a discharge port 35 and has a discharge valve 36 for opening and closing the discharge port 35. The compressed refrigerant gas is discharged into the discharge chamber 19 through the discharge port 35. The second housing 15 has formed therein a discharge space (or the discharge chamber 19 and the communication passage 21) that is placed under a discharge pressure. The discharge space forms a part of the interior of the housing 13.

The electric motor 12 is driven by a three-phase AC electric power. The electric motor 12 includes a stator 37 fixed to inner surface of the first housing 14 and a rotor 38 inserted in the stator 37 and fixed on the rotary shaft 29. The rotor 38 includes a rotor core 39 having formed therethrough a plurality of magnet insertion holes in axial direction of the rotary shaft 29 and a plurality of permanent magnets (not shown) inserted into the magnet insertion holes. The stator 37 includes U-phase, V-phase and W-phase coils 41 wound around the stator core 40. One end of a wire of each phase coil 41 is drawn out from the coil 41 as a lead wire 47, while the other ends of the respective wires are connected together thereby to form a neutral point 48. The neutral point 48 according to the first embodiment is formed at an upper location of the coil 41 on the side thereof adjacent to the compression mechanism 11 side and the other ends of the respective phase wires are connected together to form a conductive part.

The electric motor 12 is driven under the control of a motor control device 42 that is provided on outer wall of the first housing 14. The motor control device 42 includes an inverter 44 and a cover 43 that is joined to the outer wall of the first housing 14 and protects the inverter 44. The cover 43 is made of the same material, or aluminum alloy, as the first housing 14. The first housing 14 and the cover 43 cooperate to form a sealed space where the inverter 44 and a hermetic terminal 45 electrically connected to the inverter 44 are provided. The inverter 44 receives from outside power source a DC power for driving the compressor 10 and converts DC power to AC power. The inverter 44 is fixed to the outer wall of the first housing 14 and electrically insulated therefrom.

The hermetic terminal 45 is electrically connected to the inverter 44 through a connector provided for the inverter 44. A cluster block 46 is provided in the first housing 14 and the hermetic terminal 45 is electrically connected through the cluster block 46 to the respective lead wires 47 drawn out from the phase coils 41. The cluster block 46 is made of an insulation material such as a plastic and formed in the shape of a box. The cluster block 46 has formed therein terminal holes (not shown) which opens at the upper surface of the cluster block 46 and through which terminal pins of the hermetic terminal 45 are inserted. Terminal pin of the hermetic terminal 45 and contact pin provided in the terminal hole of the cluster block 46 cooperate to form the conductive part. The electric motor 12 and the inverter 44 are thus electrically connected to each other. Energization of the coil 41 of the electric motor 12 by the inverter 44 through the hermetic terminal 45 makes the rotor 38 rotate thereby to operate the compression mechanism 11 connected to the rotary shaft 29.

The compressor according to the first embodiment includes the suction check valve 51 provided in the tube 18 connected to the inlet 17 and the discharge check valve 52 provided in the tube 24 connected to the outlet 20. The suction check valve 51 and the discharge check valve 52 serve as the check valve of the present invention.

Figure 2:
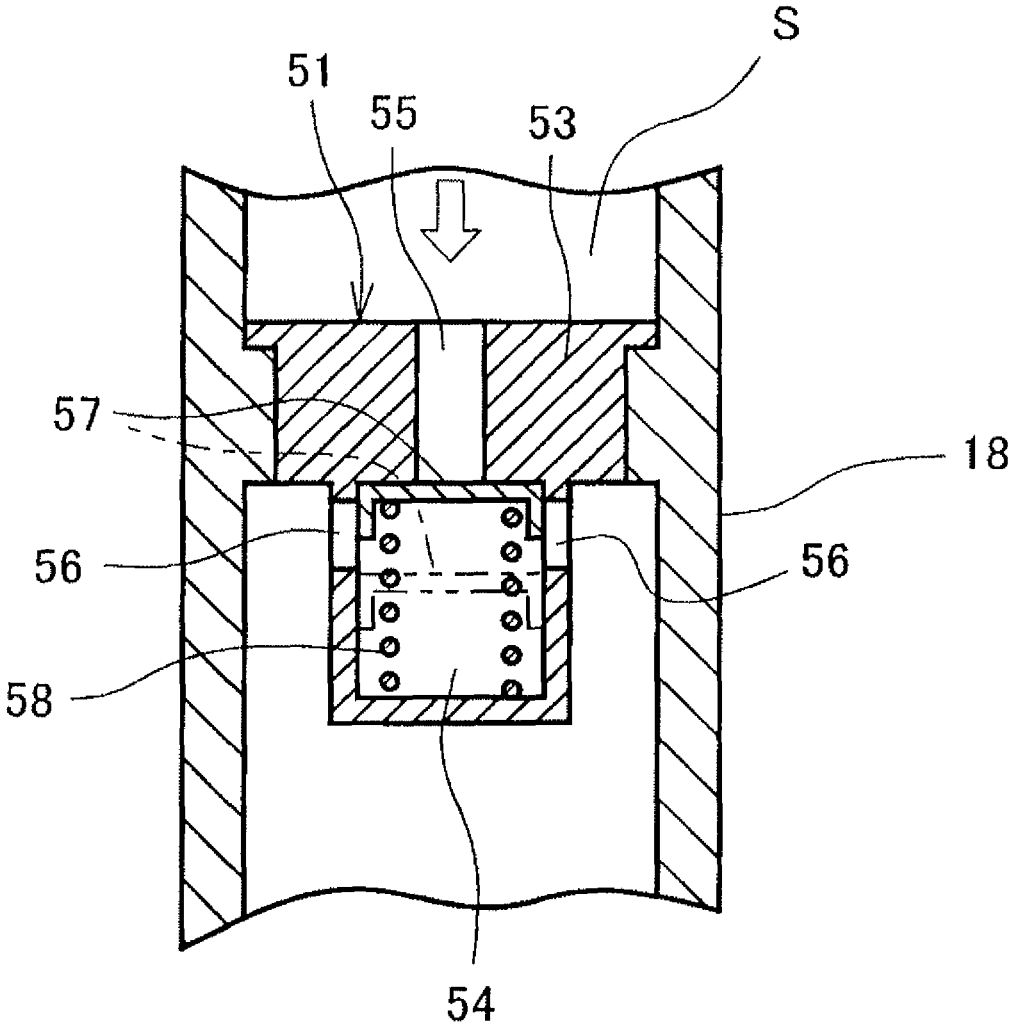
FIG. 2 is a fragmentary longitudinal cross sectional view showing a check valve on suction side of the motor-driven compressor of FIG. 1.

The following will describe the suction check valve 51 with reference to FIG. 2. The suction check valve 51 includes a valve housing 53 provided in the tube 18 forming the suction passage S. The valve housing 53 has formed therein a valve body chamber 54, a valve opening 55 providing a fluid communication between the valve body chamber 54 and the suction passage S on the external refrigerant circuit side when the valve opening 55 is opened and an opening 56 providing a fluid communication between the valve body chamber 54 and the suction passage S on the inlet 17 side. A valve body 57 and a coil spring 58 as an urging member are provided in the valve body chamber 54.

The valve body 57 which is movable reciprocally in the valve body chamber 54 normally closes the valve opening 55 by the urging force of the coil spring 58 and opens the valve opening 55 when the pressure of refrigerant gas in the suction passage S on the external refrigerant circuit side increases or the pressure of refrigerant gas in the suction passage S on the inlet 17 side decreases. Specifically, the valve body 57 opens the valve opening 55 when the pressure difference between refrigerant gas on the external refrigerant circuit side and on the inlet 17 side exceeds a predetermined value and closes the valve opening 55 when the pressure difference falls below the predetermined value.

The coil spring 58 is provided in the valve body chamber 54 so as to urge the valve body 57 in such the direction that causes the valve body 57 to move toward the valve opening 55. Spring constant of the coil spring 58 is set so as to urge the valve body 57 for closing the valve opening 55 while the compressor 10 is at a stop and also to allow the valve body 57 to open the valve opening 55 while the compressor 10 is in operation.

Figure 3:
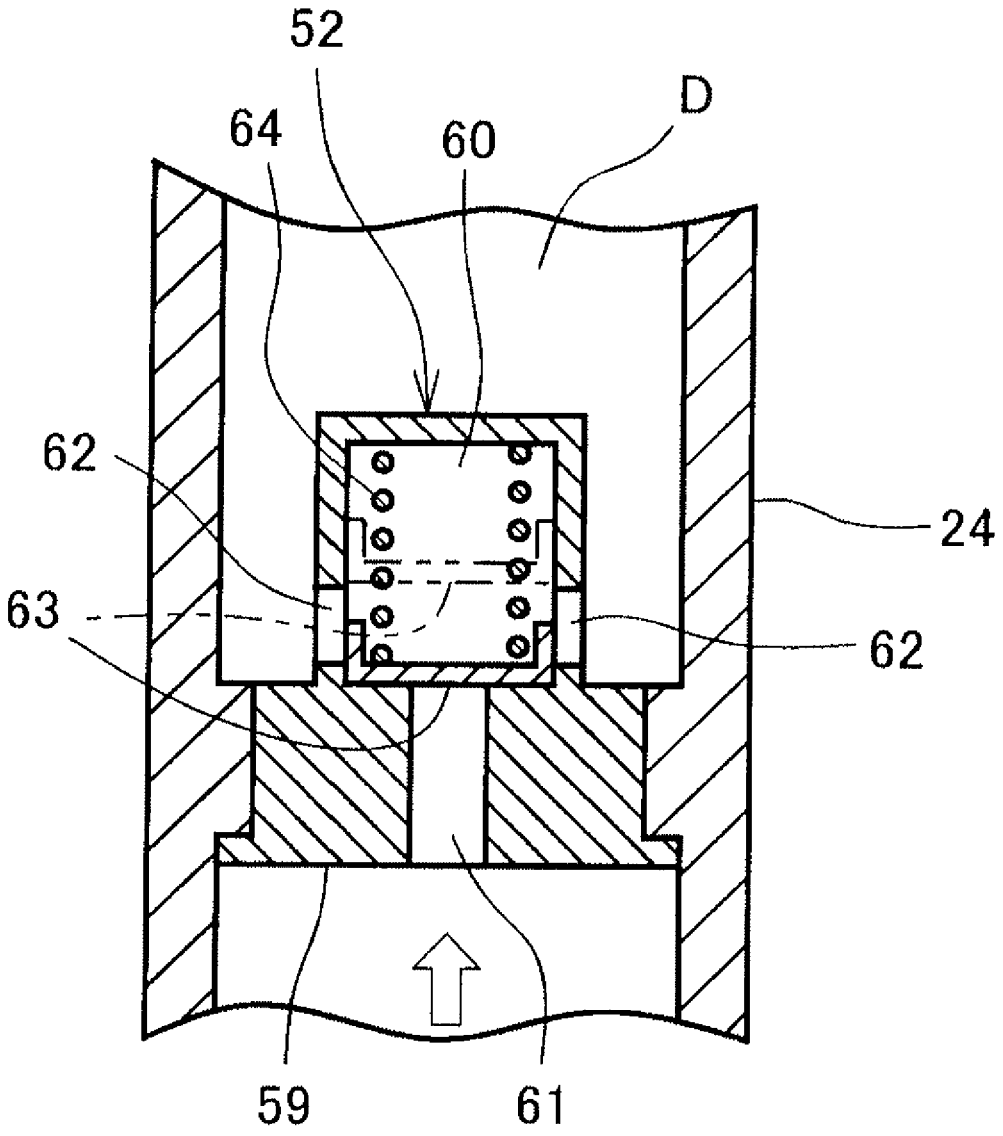
FIG. 3 is a fragmentary longitudinal cross sectional view showing a check valve on discharge side of the motor-driven compressor of FIG. 1.

The following will describe the discharge check valve 52 with reference to FIG. 3. The discharge check valve 52 is operable to allow refrigerant gas to flow toward the discharge passage ID in the external refrigerant circuit from the outlet 20 of the compressor 10 and also to prevent refrigerant gas from flowing from the discharge passage D in the external refrigerant circuit toward the outlet 20 of the compressor 10. In other words, the discharge check valve 52 prevents refrigerant gas from flowing back from the external refrigerant circuit to the outlet 20. The discharge check valve 52 includes a valve housing 59 provided in the tube 24 forming the discharge passage D. The valve housing 59 has formed therein a valve body chamber 60, a valve opening 61 providing a fluid communication between the valve body chamber 60 and the discharge passage ID on the outlet 20 side when the valve opening 61 is opened and an opening 62 providing a fluid communication between the valve body chamber 60 and the discharge passage D on the external refrigerant circuit side. A valve body 63 and a coil spring 64 as an urging member are provided in the valve body chamber 60.

The valve body 63 which is movable reciprocally in the valve body chamber 60 normally closes the valve opening 61 by the urging force of the coil spring 64 while the compressor is at a stop and opens the valve opening 61 while the compressor 10 is in operation.

The coil spring 64 is provided in the valve body chamber 60 so as to urge the valve body 63 in the direction that causes the valve body 63 to move toward the valve opening 61. Spring constant of the coil spring 64 is set so as to urge the valve body 63 for closing the valve opening 61 while the compressor 10 is at a stop and also to allow the valve body 63 to open the valve opening 61 while the compressor 10 is in operation.

The following will describe the operation of the compressor 10 according to the first embodiment. During the stop of the compressor 10, the suction check valve 51 and the discharge check valve 52 are both closed. When electric power is supplied to the electric motor 12 for rotating the rotor 38, the compression mechanism 11 draws refrigerant gas into the compression chamber 27 through the suction port 32 for compressing refrigerant gas and discharges compressed refrigerant gas into the discharge chamber 19 through the discharge port 35. The pressure of refrigerant gas in the suction space of the first housing 14 that is in communication with the suction port 32 is decreased by the operation of the compression mechanism 11 at a start-up of the compressor. When the pressure of refrigerant gas in the suction space of the first housing 14 is decreased to a predetermined level, the valve body 57 of the suction check valve 51 moves in the direction to open the valve opening 55 against the urging force of the coil spring 58. The suction check valve 51 is opened and refrigerant gas flows into the suction space of the first housing 14 through the tube 18 and the inlet 17 of the compressor 10. The suction check valve 51 is kept open while the compressor 10 continues its compressing operation.

Meanwhile, when refrigerant gas is discharged from the compression mechanism 11 at a start-up of the compressor 10, the pressure of refrigerant gas in the discharge chamber 19 and the communication passage 21 is increased. When the pressure of refrigerant gas in the discharge chamber 19 and the communication passage 21 is increased to a predetermined level, the valve body 63 of the discharge check valve 52 is moved away from the valve opening 61 and the discharge check valve 52 is opened, so that discharged refrigerant gas flows out into the external refrigerant circuit through the tube 24. The discharge check valve 52 is kept open while the compressor 10 continues its compressing operation. Additionally, while the compressor 10 continues its compressing operation, refrigerant gas is discharged out of the housing 13 continuously, so that accumulation of a large amount of liquid refrigerant in the housing 13 is prevented.

When the compressor 10 stops the compressing operation by a stop of the electric motor 12, the suction check valve 51 and the discharge check valve 52 are both closed, as shown in FIGS. 2 and 3. The vehicle air conditioner is cooled with an elapse of time and the refrigerant gas in the compressor 10 and in the external refrigerant circuit is cooled to be liquefied, accordingly. During a stop of the compressor 10 when the suction check valve 51 and the discharge check valve 52 are both closed, no liquid refrigerant in the external refrigerant circuit is allowed to flow into the suction and the discharge spaces of the housing 13 through the tubes 18, 24, respectively. Refrigerant gas in the suction and the discharge spaces of the housing 13 is liquefied, but no liquid refrigerant in the external refrigerant circuit is allowed to flow into the suction and the discharge spaces of the housing 13, so that only a small amount of liquid refrigerant is accumulated in the suction and the discharge spaces of the housing 13. Therefore, the hermetic terminal 45, the cluster block 46 and the neutral point 48 each having the conductive part are prevented from being immersed in the liquid refrigerant.

Additionally, accumulation of only a small amount of liquid refrigerant in the suction and the discharge spaces of the housing 13 makes it easy to prevent an excessive increase of the pressure of refrigerant gas in the housing 13 due to the vaporization of liquid refrigerant at a start-up of the compressor 10. Therefore, the load on the compression mechanism 11 and the power consumption of the electric motor 12 can be prevented from increasing.

The compressor 10 according to the first embodiment offers the following advantageous effects.

(1) During the compressing operation of the compressor 10, the suction check valve 51 provided in the suction passage S and the discharge check valve 52 provided in the discharge passage D are both opened. Refrigerant gas is allowed to flow into the compression mechanism 11 through the suction passage S and the suction space of the housing 13 and the refrigerant gas compressed in the compression mechanism 11 flows out therefrom into the external refrigerant circuit through the discharge passage D. During the stop of the compressor 10, the suction check valve 51 and the discharge check valve 52 are both closed. Therefore, liquid refrigerant is prevented from flowing into the suction and the discharge spaces of the housing 13 through the suction passage S and the discharge passage D, respectively, with the result that accumulation of liquid refrigerant in the housing 13 can be prevented while the compressor 10 is at a stop.

(2) While the suction check valve 51 is closed during the stop of the compressor, liquid refrigerant is prevented from flowing into the suction space of the housing 13 from the suction passage S that is located more adjacent to the electric motor 12 than the discharge passage D, so that the electric motor 12 is hardly immersed in liquid refrigerant in the suction space of the first housing 14. Any refrigerant liquefied in the suction space of the first housing 14 in a small volume will not cause the electric motor 12 to be immersed in liquid refrigerant. Therefore, the hermetic terminal 45, the cluster block 46 and the neutral point 48 each having the conductive part and provided in the electric motor 12 at a position adjacent thereto are prevented from being immersed in liquid refrigerant accumulated in the housing 13, with the result that the conductive parts can be insulated successfully from the metal housing 13.

(3) No refrigerant gas is allowed to flow into the housing 13 through the suction passage S and the discharge passage D during the stop of the compressor 10 and, so that only a small amount of liquid refrigerant is accumulated in the housing 13. Therefore, a pressure increase of refrigerant gas due to vaporization of liquid refrigerant at a start-up of the compressor 10 is prevented easily, so that the load applied to the compression mechanism 11 can be reduced and the power consumption of the electric motor 12 can be prevented from increasing.

(4) Accumulation of only a small amount of liquid refrigerant in the housing 13 permits a higher degree of freedom of positioning the conductive parts (or the hermetic terminal 45, the cluster block 46 and the neutral point 48) that are disposed in the electric motor 12 and in the vicinity thereof. For example, the conductive part may be disposed at a position more adjacent to the bottom of the housing 13 than in the prior art.

(5) The accumulation of only a small amount of liquid refrigerant in the housing 13 helps to maintain the insulation between the coil 41 and the housing 13 and between the coil 41 and the conductive part even if a pinhole is formed in the insulating enamel coating of winding wire of the coil 41.

The following will describe a compressor according to the second embodiment. The compressor according to the second embodiment which is designated by numeral 70 in FIG. 4 differs from that according to the first embodiment in that the compressor 70 is provided with a suction check valve, but dispenses with a discharge check valve. The rest of the structure of the compressor 70 is substantially the same as that of the first embodiment. For the sake of convenience of explanation, like or same parts or elements will be referred to by the same reference numerals as those which have been used in the description of the first embodiment, and the description thereof will be omitted.

Figure 4:
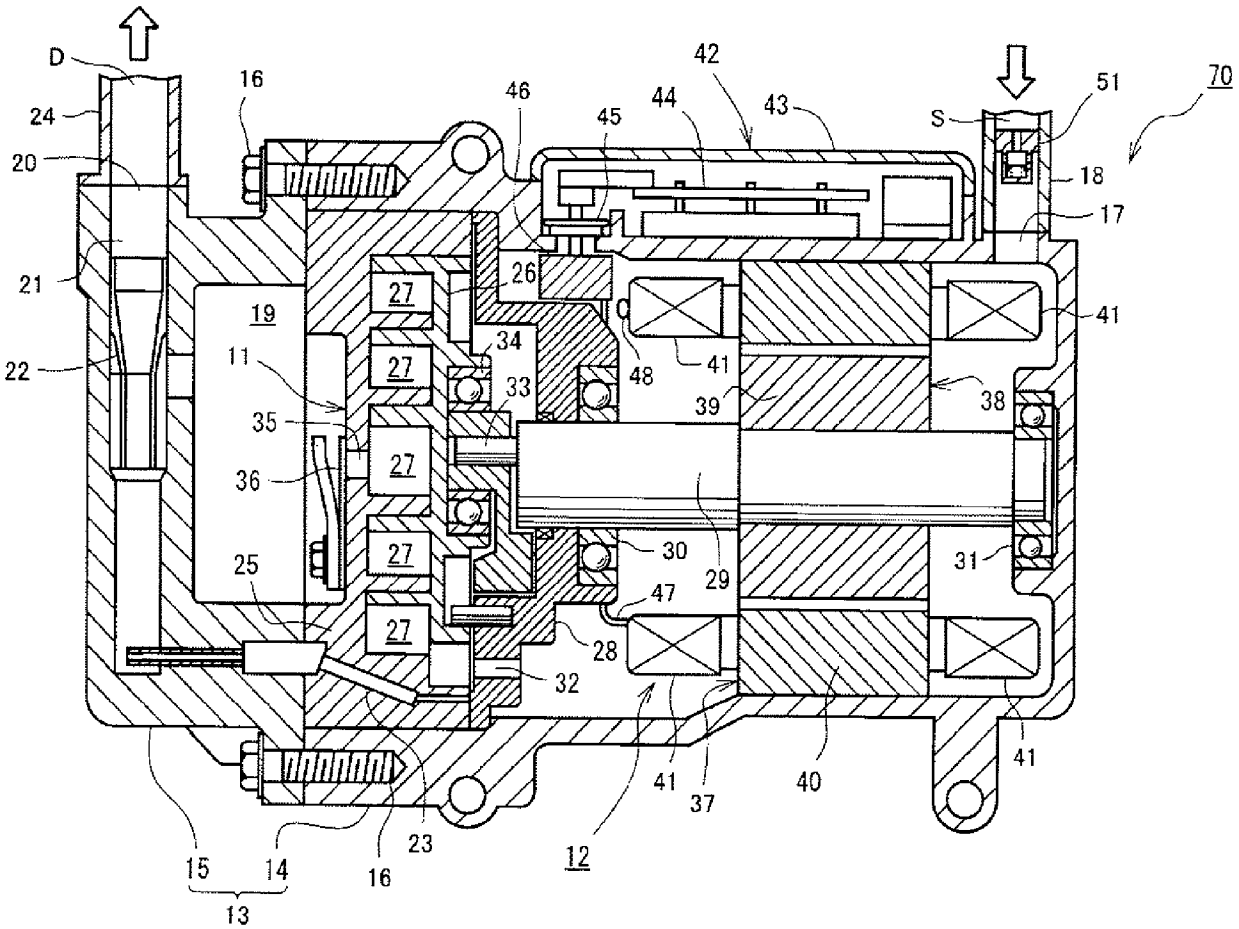
FIG. 4 is a longitudinal cross sectional view of a motor-driven compressor according to a second embodiment of the present invention.

As shown in FIG. 4, the compressor 70 has no discharge check valve such as 52 in the tube 24 of the discharge passage D, but is provided with a suction check valve 51 in the tube 18 of the suction passage S. During the compressing operation of the compressor 70, refrigerant gas discharged from the compression mechanism 11 into the discharge chamber 19 flows toward the external refrigerant circuit through the oil separator 22, the communication passage 21 and the outlet 20. When the compressor 70 is stopped, the suction check valve 51 is closed, so that refrigerant liquefied in the suction passage S due to cooling is prevented from flowing into the suction space of the housing 13 through the suction check valve 51.

Meanwhile, refrigerant that is liquefied in the discharge passage D flows into the discharge space in the second housing 15 from the outlet 20. The compression mechanism 11 according to the second embodiment is also of a scroll type, so that no liquid refrigerant in the second housing 15 can pass through the compression mechanism 11 to reach the first housing 14 (or the electric motor 12). In other words, liquid refrigerant flowing into the second housing 15 from the outlet 20 can be prevented by the compression mechanism 11 from flowing into the first housing 14.

In the second embodiment, the provision of the suction check valve 51 in the suction passage S can prevent liquid refrigerant from flowing into the first housing 14 without providing a discharge check valve such as 52 in the tube 24 of the discharge passage D. The compressor 70 dispenses with the discharge check valve 52 of the compressor 10, so that the compressor 70 can reduce the number of parts as compared with the compressor 10 having the discharge check valve 52.

The present invention is not limited to the above-described embodiments, but may be practiced in various ways as exemplified below.

In the embodiments, the check valve has a spring that urges the valve to be closed, but the check valve may be of an electromagnetic type in which the check valve is electromagnetically controlled to be opened and closed. In other words, the structure for opening and closing the check valve is not limited to the illustrated embodiments as far as the check valve is opened during the operation of the compressor and closed during the stop thereof.

In the embodiments, the check valve is opened after a start-up of the compressor but may be opened simultaneously with the start-up of the compressor.

The check valves are provided in both of the suction and discharge passages in the first embodiment and the check valve is provided only in the suction passage in the second embodiment. According to the present invention, the check valve may be provided in at least one of the suction passage and the discharge passage. For example, the check valve may be provided only in the discharge passage.

Though in the embodiments the electric motor is provided in the housing that is under a suction pressure, the electric motor may be provided in the housing under a discharge pressure. In the latter case, the space in the housing where the electric motor is disposed is communicable with the discharge passage and the discharge passage is located more adjacent to the electric motor than the suction passage. In this case, it is preferable to provide the check valve in the discharge passage so as to prevent liquid refrigerant from flowing into the space where the electric compressor is disposed.

Though in the embodiments the suction passage and discharge passage of the embodiments are formed outside the housing, the passages may be formed inside the housing. For example, the communication passage formed in the second housing may serve as the discharge passage and the check valve may be provided in the communication passage. Alternatively, the tube forming the suction passage may be extended into the suction space of the first housing where the electric motor is disposed and the check valve may be provided in the extended suction passage that is located in the suction space of the first housing.

The compressor according to the present invention is not limited to a scroll type described in the embodiments. The compressor may be of a vane type.

What is claimed is:

1. A motor-driven compressor in a vehicle comprising:

an electric motor including a horizontally disposed rotary shaft;

a compression mechanism connected to the rotary shaft of the motor and having a compression chamber therein so as to compress refrigerant gas in the compression chamber by rotation of the motor;

a metal housing accommodating the electric motor and the compression mechanism;

a suction passage communicable with an interior of the housing, the suction passage through which refrigerant gas flows;

a discharge passage communicable with the interior of the housing and an external refrigerant circuit, a discharge chamber connected to the discharge passage, wherein refrigerant gas compressed in the compression chamber is discharged to the discharge chamber, and flows through the discharge passage to the external refrigerant circuit;

a discharge port provided in the compression mechanism that connects the compression chamber with the discharge chamber to discharge the compressed refrigerant to the discharge chamber;

a discharge valve provided in the compression mechanism to open and close the discharge port;

a passage configured to communicate the discharge passage with the compression mechanism, bypassing the discharge chamber;

a check valve provided in the discharge passage, configured to be opened while the compressor is in operation and closed while the compressor is at a stop to prevent liquid refrigerant outside the compressor from flowing into the compressor; and a conductive part disposed in a vicinity of the electric motor and above the horizontally disposed rotary shaft, wherein the conductive part includes a neutral point at which ends of wires are connected together.

2. The motor-driven compressor according to claim 1, wherein the discharge passage is located more adjacent to the electric motor than the suction passage.

3. The motor-driven compressor according to claim 1, wherein an additional check valve is provided in the suction passage.

4. The motor-driven compressor according to claim 3, wherein the suction passage is communicable with a suction space in the interior of the housing where the electric motor is disposed and the discharge passage is communicable with the interior of the housing where the compression mechanism is disposed.

5. The motor-driven compressor according to claim 3, wherein the suction passage is located more adjacent to the electric motor than the discharge passage.

* * * * *